US006840336B2

(12) United States Patent
Schaaf et al.

(10) Patent No.: US 6,840,336 B2
(45) Date of Patent: Jan. 11, 2005

(54) DRILLING TOOL WITH NON-ROTATING SLEEVE

(75) Inventors: Stuart Schaaf, Houston, TX (US); Alain Dorel, Houston, TX (US); Albert E. Patterson, II, Beasley, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/140,192

(22) Filed: May 6, 2002

(65) Prior Publication Data

US 2002/0179336 A1 Dec. 5, 2002

Related U.S. Application Data

(60) Provisional application No. 60/296,020, filed on Jun. 5, 2001.

(51) Int. Cl.[7] ..... E21B 7/04

(52) U.S. Cl. ..... 175/27; 175/61; 175/76

(58) Field of Search ..... 175/27, 61, 62, 175/73, 76

(56) References Cited

U.S. PATENT DOCUMENTS

| | | | | |
|---|---|---|---|---|
| 3,743,034 A | | 7/1973 | Bradley | |
| RE29,526 E | | 1/1978 | Jeter | |
| 4,635,736 A | * | 1/1987 | Shirley | 175/76 |
| 5,113,953 A | | 5/1992 | Noble | |
| 5,553,678 A | | 9/1996 | Barr et al. | |
| 6,089,332 A | | 7/2000 | Barr et al. | |
| 6,092,610 A | | 7/2000 | Kosmala et al. | |
| 6,109,372 A | | 8/2000 | Dorel et al. | |
| 6,158,529 A | | 12/2000 | Dorel | |
| 6,206,108 B1 | | 3/2001 | MacDonald et al. | |
| 6,244,361 B1 | | 6/2001 | Comeau et al. | |
| 6,321,857 B1 | | 11/2001 | Eddison | |
| 6,340,063 B1 | | 1/2002 | Comeau et al. | |
| 6,595,303 B2 | * | 7/2003 | Noe et al. | 175/74 |
| 2001/0011591 A1 | * | 8/2001 | Van-Drentham Susman et al. | 166/298 |

FOREIGN PATENT DOCUMENTS

| | | |
|---|---|---|
| EP | 1 106 777 A1 | 6/2001 |
| GB | 2 172 324 B | 7/1988 |
| GB | 2 172 325 | 7/1988 |
| GB | 2 177 738 | 8/1988 |
| WO | WO 00/57018 | 9/2000 |

OTHER PUBLICATIONS

Comeaux B.C., "Implementation of a Next Generation Rotary Steerable System," *AADE 01–NC–HO–25 National Drilling Conference*, pp. 1–7, Houston TX (Mar. 27–29, 2001).

Gruenhagen H., Hahne U. & Alvord G., "Application of New Generation Rotary Steerable System for Reservoir Drilling in Remote Areas," *IADC/SPE 74457 Drilling Conference*, pp. 1–7, Dallas TX (Feb. 26–28, 2002).

"The AutoTrak® System," *Baker Hughes Inteq* Advertising Brochure, Baker Hughes Incorporated (2001).

* cited by examiner

*Primary Examiner*—Wlliam Neuder
(74) *Attorney, Agent, or Firm*—Brigitte L. Echols; John Ryberg

(57) ABSTRACT

The invention refers to a drilling tool and method that, among other aspects, provides for a sleeve with expansible pads for positioning the drilling tool in the desired direction during drilling. The pads are hydraulically expanded and retracted by a valve system which selectively diverts mud flowing through the tool to the desired pads. The tool may also be provided with a flexible tube connecting the sleeve to drilling tool for maneuvering along deviations or curves in the wellbore.

28 Claims, 8 Drawing Sheets

DRILLING TOOL WITH NON-ROTATING SLEEVE

CROSS-REFERENCE TO RELATED APPLICATIONS

This application claims priority from Provisional Application No. 60/296,020, filed Jun. 5, 2001.

STATEMENT REGARDING FEDERALLY SPONSORED RESEARCH OR DEVELOPMENT

Not applicable.

BACKGROUND OF INVENTION

1. Field of the Invention

The invention relates generally to methods and apparatus for drilling of wells, particularly wells for the production of petroleum products. More specifically, it relates to a drilling system with a non-rotating sleeve.

2. Background Art

When drilling oil and gas wells for the exploration and production of hydrocarbons, it is very often necessary to deviate the well from vertical and along a particular direction. This is called directional drilling. Directional drilling is used for, among other purposes, increasing the drainage of a particular well by, for example, forming deviated branch bores from a primary borehole. Also it is useful in the marine environment, wherein a single offshore production platform can reach several hydrocarbon reservoirs using a number of deviated wells that spread out in any direction from the production platform.

Directional drilling systems usually fall within two categories, classified by their mode of operation: push-the-bit and point-the-bit systems. Push-the-bit systems operate by pushing the drilling tool laterally on one side of the formation containing the well. Point-the-bit systems aim the drill bit to the desired direction therefore causing the deviation of the well as the bit drills the well's bottom.

The push-the-bit systems can utilize an external anti-rotation device or an internal anti-rotation mechanism. In the systems utilizing an internal anti-rotation mechanism the means for applying lateral force to the wellbore's side walls rotate with the drill collar. A push-the-bit system utilizing internal anti-rotation mechanism is described, for example, in U.S. Pat. No. 6,089,332 issued on Jul. 19, 2000 to Barr et al. This patent discloses a steerable rotary drilling system having a roll stabilized control unit with hydraulic actuators which position the shaft and steer the bit.

International patent application no. WO 00/57018 published on 28 Sep. 2000 by Weatherford/Lamb, Inc. also discloses a push-the bit system utilizing an external anti-rotation device. The system described therein is a rotary steerable system with a pad on a stabilizer activated to kick the side of the wellbore. The stabilizer is non-rotary and slides through the wellbore.

Push-the-bit systems utilizing external anti-rotation device may involve applying lateral force to the wellbore's side wall using systems de-coupled from drillstring rotation. For example, U.S. Pat. No. 6,206,108 issued to MacDonald et al. on Mar. 27, 2001 discloses a drilling system with adjustable stabilizers with pads to effect directional changes.

Various techniques have also been developed for point-the-bit systems. An example of a point-the-bit system utilizing an external anti-rotation device is disclosed in U.S. Pat. No. 6,244,361 issued to Comeau et al. on Jun. 12, 2001.

This patent discloses a drilling direction control device including a shaft deflection assembly, a housing and a rotatable drilling shaft. The desired orientation is achieved by deflecting the drilling shaft. Other examples of point-the-bit systems utilizing external anti-rotation device are disclosed in U.K. Patent Nos. 2,172,324; 2,172,325 and 2,177,738 each to Douglas et al. The Douglas patents disclose that directional control is achieved by delivering fluid to an actuating means to manipulate the position of the drilling apparatus.

An example of a point-the-bit system utilizing internal anti-rotation mechanism is described in U.S. Pat. No. 5,113,953 issued on May 19, 1992 to Noble. This patent discloses a directional drilling apparatus with a bit coupled to a drill string through a universal joint which allows the bit to pivot relative to the string axis. The tool is provided with upper stabilizers having a maximum outside diameter substantially equal to the nominal bore diameter of the well being drilled and lower stabilizers having the same or slightly lesser diameter.

Despite the advancements of the steerable systems, there remains a need to further develop steerable drilling systems which can be utilized for three dimensional control of a borehole trajectory. It is desirable that such a system include, among others, one or more of the following: a simple and robust design concept; preferably without rotating oil/mud seals; and/or incorporating technology used in mud-lubricated bearing sections of positive displacement motors (PDMs) and/or variable gauge stabilizers. It is also desirable for such a system to include, among others, one or more of the following: a non-rotating stabilizer sleeve preferably de-coupled from drillstring rotation; a directional drilling and/or control mechanism actuated by drilling fluids and/or mud; a rotating section including active components such as electric drive, pumps, electric valves, sensors, and/or reduced electrical; and/or hydraulic connections between rotating and non-rotating parts. The present invention has been developed to achieve such a system.

SUMMARY OF INVENTION

The present invention relates to a drilling tool having at least one drill collar and a drill bit. The drilling tool comprises a shaft adapted to a drill string for rotation of the drill bit, a sleeve having pads hydraulically extensible therefrom, the sleeve positioned about at least a portion of the shaft, a tube connecting the sleeve to the drill collar, the tube adapted to conduct drilling fluid therethrough and a valve system adapted to operatively conduct at least a portion of the drilling fluid to the pads whereby the pads move between the an extended and retracted position.

The invention also relates to a drilling tool positionable in a wellbore, the drilling tool having at least one drill collar, a rotating shaft and a drill bit rotated by the shaft to drill the wellbore. The drilling tool comprises a non-rotating sleeve having extendable pads therein and an actuator. The sleeve positioned about at least a portion of the shaft. The actuator is adapted to divert at least a portion of a fluid passing through the tool to the sleeve whereby the pads are selectively moved between an extended and retracted position.

The present invention also relates to a radial seal for use in a downhole drilling tool, the downhole drilling tool comprising a sleeve and a shaft therein. The radial seal comprises an outer ring positionable adjacent the sleeve, an inner ring positionable adjacent the shaft and an elastomeric ring positionable adjacent one of the rings whereby the misalignment of the sleeve to the inner shaft is absorbed.

In another aspect, the invention also relates to a method of drilling a wellbore. The method comprises positioning a drilling tool in a wellbore, the drilling tool having a bit and a sleeve with extendable pads therein; passing a fluid through the tool; and diverting at least a portion of the fluid to the sleeve for selective extension of the pads whereby the tool drills in the desired direction Other aspects and advantages of the invention will be apparent from the following description and the appended claims.

DETAILED DESCRIPTION

Figure 1:
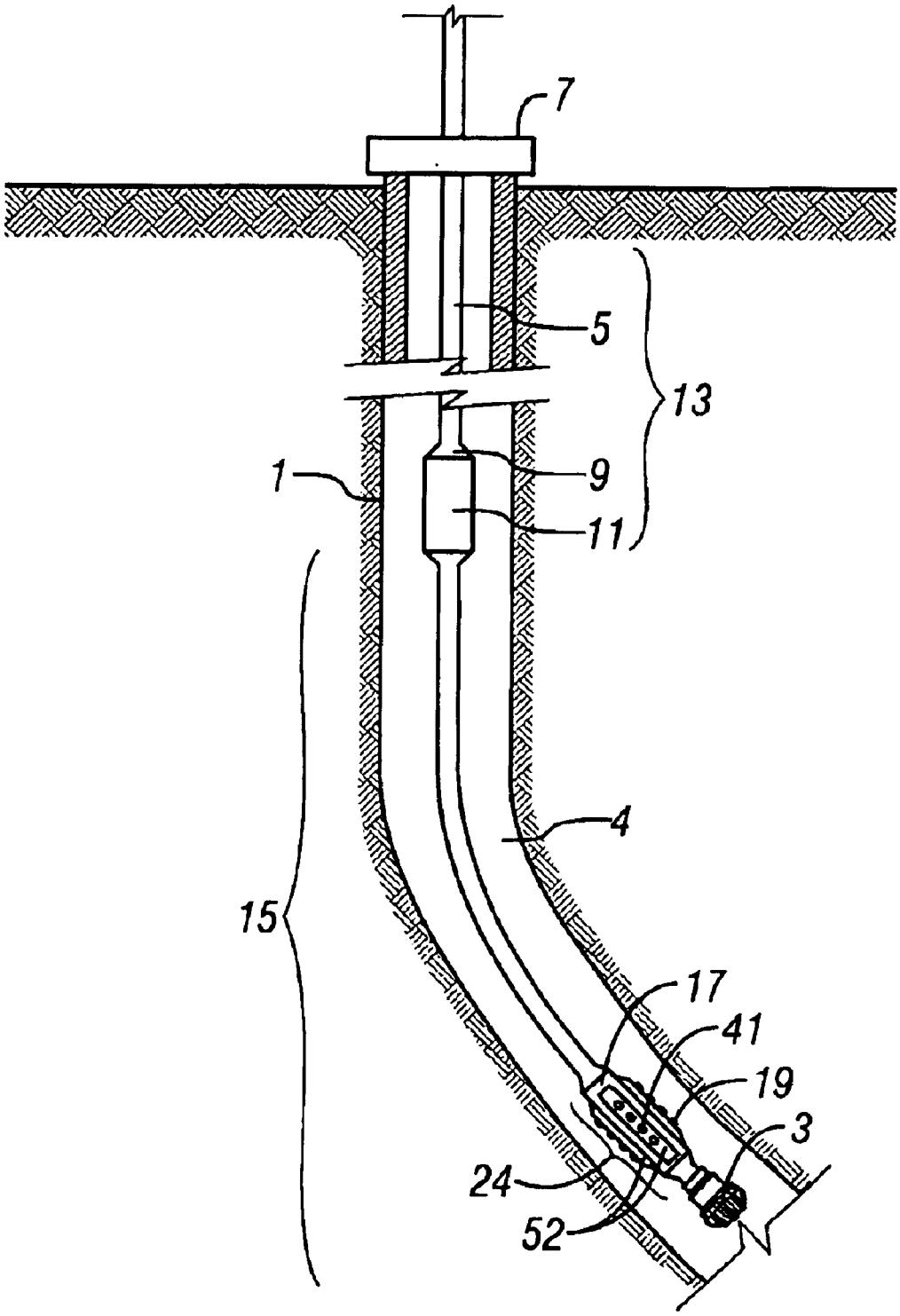
FIG. 1 is an illustration of a well being drilled by a downhole tool including a rotary steerable drilling tool.

FIG. 1 shows a wellbore (1) with a downhole tool (4) including a drill string (5), a rotary steerable tool (17) and a drill bit (3). The drill string (5) extends upwardly to the surface where it is driven by a rotary table (7) of a typical drilling rig (not shown). The drill string (5) includes a drill pipe (9) having one or more drill collars (11) connected thereto for the purpose of applying weight to a drill bit (3) for drilling the wellbore (1). The well bore is shown as having a vertical or substantially vertical upper portion (13) and a curved lower portion (15). It will be appreciated that the wellbore may be of any direction or dimension for the purposes herein.

The rotary steerable drilling tool (17) includes a non-rotating sleeve (19) that is preferably surrounded by extendable and/or retractable pads (41) in order to, for example, stabilize the drill string at a specific position within the well's cross section, or for changing the direction of the drill bit (3). The pads (41) are preferably extended or retracted, i.e. actuated, by the drilling fluid and/or mud passing through the downhole tool (4) as will be described more fully herein.

Figure 2:
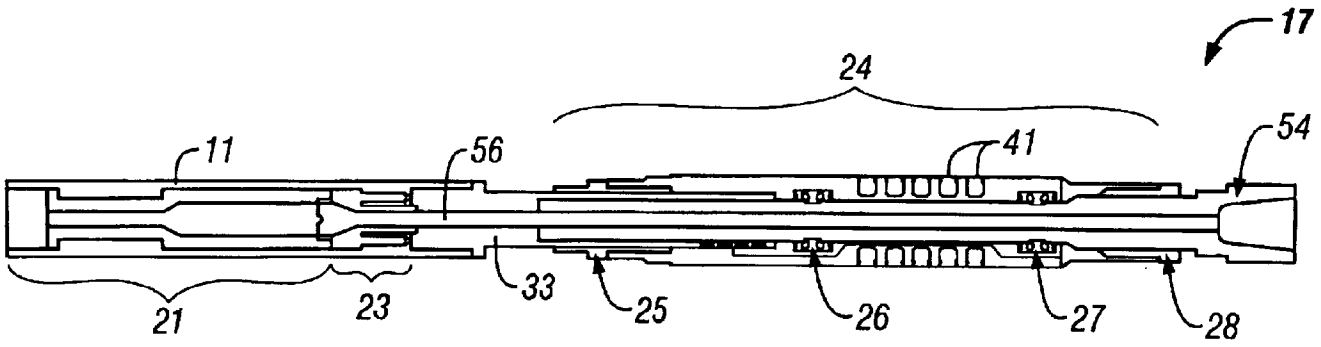
FIG. 2 is a longitudinal sectional view of a portion of the downhole tool of FIG. 1 showing the rotary steerable drilling tool in greater detail.

A portion of the downhole tool (4) incorporating the rotary steerable drilling tool (17) is shown in greater detail in FIG. 2. The rotary steerable drilling tool (17) includes at least four main sections: a control and sensing section (21), a valve section (23), non-rotating sleeve section (24) surrounding a central shaft (54), and a flexible shaft (33) connecting the sleeve section (24) to the rotating drill collar (11). A central passage (56) extends through the tool (17).

Figure 3:
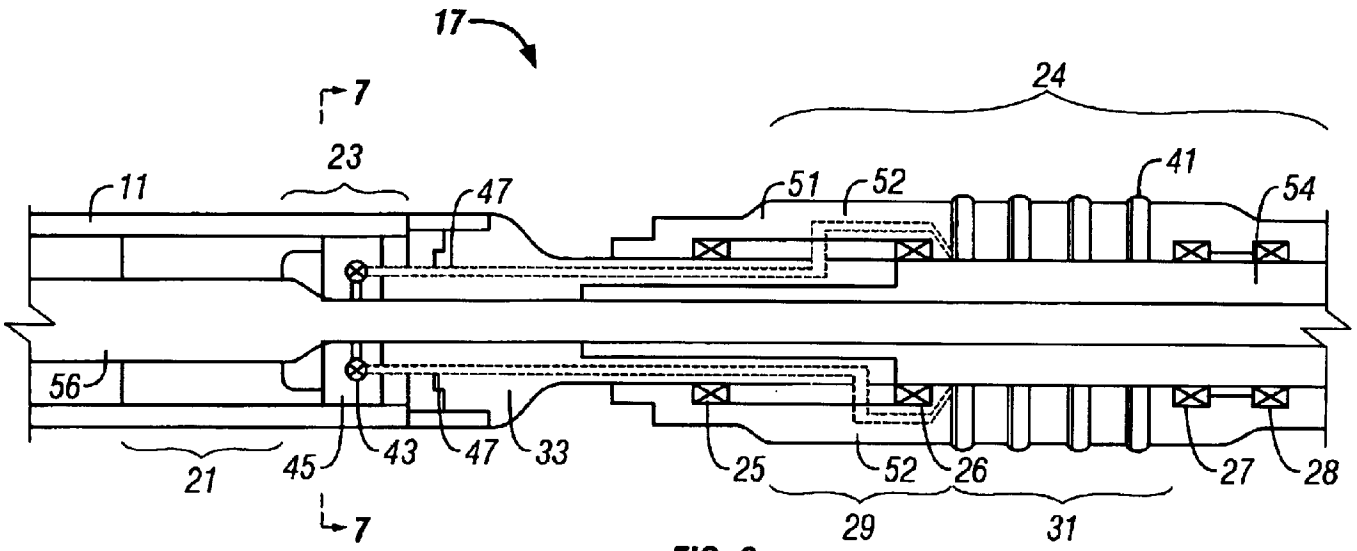
FIG. 3 is a longitudinal sectional view of a portion of the rotary steerable tool of FIG. 2 depicting the non-rotating sleeve section.

A more detailed view of the rotary steerable drilling tool (17) is shown in FIG. 3. The control and sensing section (21) is positioned within the drill collar (11) and includes sensors (not shown) to, among other things, detect the angular position of the sleeve section (24) and/or the position of the valve section (23) within the tool. Position information may be used in order to, for example, determine which pad (41) to actuate.

The control and sensing section preferably includes sensors (not shown) to determine the position of the non-rotating sleeve with respect to gravity and the position of the valve assembly to determine which pads are activated. Additional electronics may be included, such as acquisition electronics, tool face sensors, and electronics to communicate with measurement while drilling tools and/or other electronics. A tool face sensor package may be utilized to determine the tool face of the rotating assembly and compensate for drift. The complexity of these electronics can vary from a single accelerometer to a full D&I package (ie. three or more accelerometers and/or three or more magnetometers) or more. The determination of the complexity is dependent on the application and final operation specifications of the system. The complexity of the control and sensing section may also be determined by the choice of activation mechanism and the operational requirements for control, such as those discussed more fully herein.

The sleeve section (24), central shaft (54) and the drill collar (11) may preferably be united by a flexible shaft (33). Alternate devices for uniting these components may also be used. This enables the axis of the rotating drill collar (11) and the rotating central shaft (54) to move independently as desired. The flexible shaft (33) extends from the rotating drill collar (11) to the non-rotating sleeve (24) to improve control. The non-rotating sleeve section (24) includes a sleeve body (51) with a number of straight blades (52), bearing sections (25, 26, 27, 28) and pads (41). The non-rotating sleeve section (24) rests on bearing sections (25, 26, 27, 28) of the tool (17), and allows axial forces to be transmitted through the non-rotating sleeve section (24) to the rotating central shaft (54) while the non-rotating sleeve slides within the wellbore as the tool advances or retracts.

The valve section (23) operates as an activation mechanism for independent control of the pads (41). The mechanism is comprised of a valve system (43), a radial face seal assembly (not shown), an activation mechanism (45) and hydraulic conduits (47). The hydraulic conduits (47) extend from the valve section (23) to the pistons (53) and distribute drilling fluid therebetween. The valve section (23) can provide continuous and/or selective drilling fluid to conduit (s) (47). The valve section preferably incorporates an activation mechanism (45) to allow for independent control of a number of blades. Various activation mechanisms usable in connection with the drilling tool (17) will be described further herein.

Figure 4:
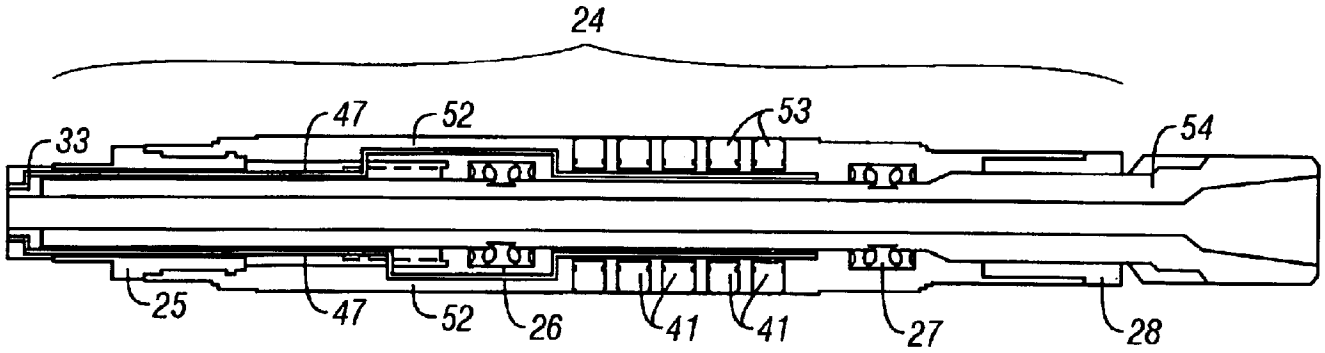
FIG. 4 is another longitudinal cross sectional view of the rotary steerable tool of FIG. 2 depicting the non-rotating sleeve section

Another view of the non-rotating sleeve section (24) is shown in FIG. 4. The sleeve section (24) preferably includes a number of hydraulic pistons (53) located on stabilizer blade (52). An anti-rotation device, such as elastic blade or rollers (not shown) may also be incorporated.

The number of blades and/or their dimension can vary and depends on the degree of control required. The number of stabilizer blades preferably varies between a minimum of three blades and a maximum of five blades for control. As the number of blades increase, better positional control may be achieved. However, as this number increases, the complexity of the activation mechanism also increases. Preferably, up to five blades are used when the activation becomes to complex. However, where the dimensions are altered the number, position and dimension of the blades may also be altered.

The pistons (53) are internal to each of the blades (52) and are activated by flow which is bypassed through the drilling tool (17) along the hydraulic conduits (47). The pistons (53) extend and retract the pads (41) as desired. The control and sensing section detect the position of the non-rotating sleeve of the downhole tool as it moves through the wellbore. By selectively activating the pistons to extend and retract the pads as described herein, the downhole tool may be controlled to change the wellbore tendency and drill the wellbore along a desire path.

The bearings (25, 26, 27, 28) are preferably mud-lubricated bearings which couple the sliding sleeve (24) to the rotating shaft (54). Bearings (25, 28) are preferably radial bearings and bearings (26, 27) are preferably thrust bearings. As applied herein, the mud-lubricated radial and thrust bearings produce a design that eliminates the need for rotating oil and mud seals. A portion of the bypassed flow through conduits (47) is utilized for cooling and lubricating these bearings.

The central shaft (54) is preferably positioned within the sleeve portion (24) and extends therefrom to the drill bit (3) (FIG. 1). The central shaft (54) allows for the torque and weight-on-bit to be transmitted from the collar through the shaft to the bit (3). The central shaft (54) also carries the radial and axial loads produced from the system.

Figure 5:
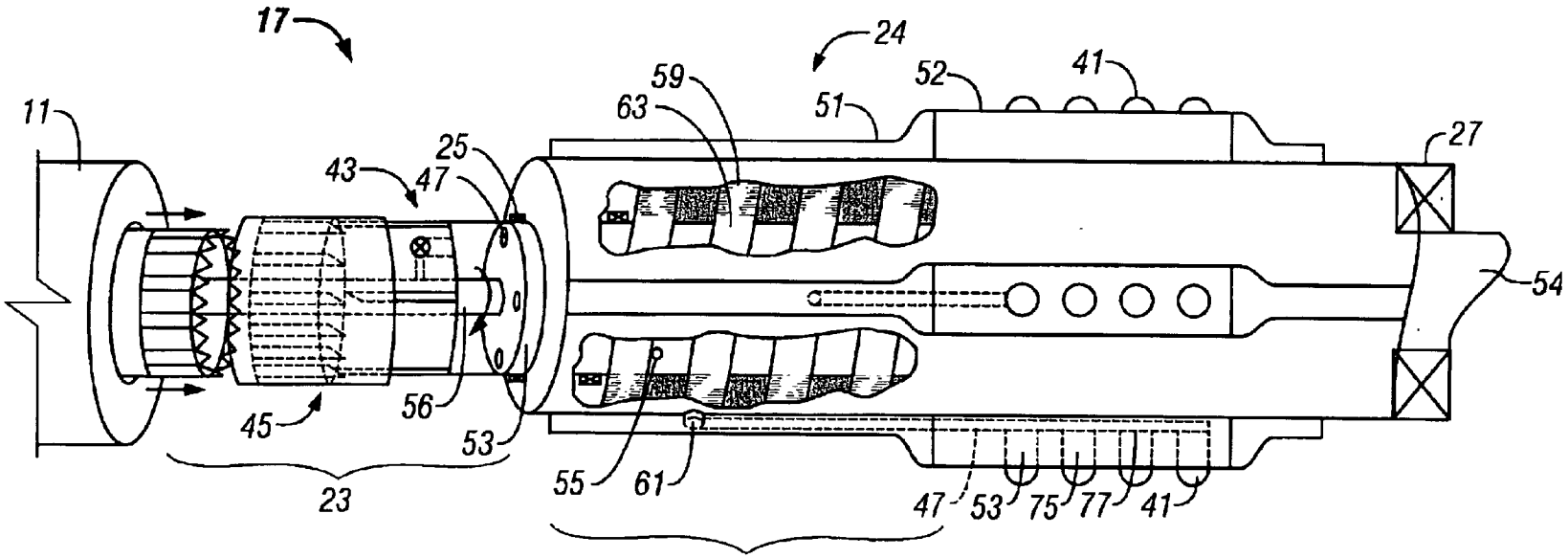
FIG. 5 is another view of the non-rotating sleeve section of FIG. 4 depicting the actuation system.

Referring now to FIG. 5, another view of the drilling tool (17), with the sleeve section (24) and valve section (23), is shown. The sleeve section (24) includes a sleeve body (51) that surrounds the central shaft (54). The bearing sections (25, 26, 27, 28 of FIGS. 2–4) are located between the sleeve body (51) and the central shaft (54).

The valve section (23) of FIG. 5 comprises the valve system (43), the actuating system (45) and a radial face seal assembly (not shown). The actuating system (45) actuates the valve system (43) in order to conduct drilling fluid to the corresponding conduit(s) (47) to actuate the corresponding pad(s) (41). With reference to FIGS. 3 and 5, the upper surface of sleeve body (51) is surrounded by stabilizer blades (52) which include the pad(s) (41). Conduits (47) extend from orifices (61) through the lower section of the supports and under the corresponding pad(s). The pad(s) (41) are located within cavities (75) embedded in the stabilizer blades (52). Each cavity (75) has an aperture (77) at its lower end for actuating the pistons (53) for each respective pad. The pistons are actuated by the fluid that exits orifices (61), travels along conduits (47) and enters cavities (75) through the lower end apertures (77).

Any number of pads and pistons may be included in the stabilizers blades (52). In some embodiments, the pad may be combined with and/or act as the piston. The designs of the pad vary according to the corresponding application. Pads could be rectangular in form and having regular or irregular exterior surfaces. According to at least one embodiment, a plurality of cylindrical pads (41) rest in cylindrical cavities (75).

The actuating system (45) can be a mechanical device that cycles the valve system's (43) outlet to a corresponding conduit (47). An example of such a mechanical device is a j-slot mechanism shown as the activation mechanism (45) of FIG. 5. The mechanical device preferably cycles a valve assembly to a new position following each pump cycle. The system operation allows a hydraulic piston in the j-slot to be activated sequentially every time the mud flow passes below a preset threshold for a minimum cycle time adjusted with a set of hydraulic nozzles. Other mechanical actuation systems, such as the Multi-Cycle Releasable Connection set forth in U.S. Pat. No. 5,857,710 issued to Leising et al. on Jan. 12, 1999, the entire contents of which is hereby incorporated by reference, may also be used In a three stabilizer blade system shown in FIG. 6, the stabilizer blades (52) extend and retract radially from the tool (17). By varying which set of pistons is extended or retracted, eight settings can be obtained with the following sequence, by way of example:

1. Pistons set #1 full gauge, set #2 and #3 under gauge: Tool Face 1=X
2. Pistons set #1 and #2 full gauge, set #3 under gauge: Tool Face 2=X+60 degrees
3. Pistons set #2 full gauge, set #1 and #3 under gauge: Tool Face 3=X+120 degrees
4. Pistons set #2 and #3 full gauge, set #1 under gauge: Tool Face 4=X+180 degrees
5. Pistons set #3 full gauge, set #1 and #3 under gauge: Tool Face 5=X+240 degrees
6. Pistons set #1 and #3 full gauge, set #2 under gauge: Tool Face 6=X+300 degrees
7. Pistons set #1, #2 and #3 full gauge: Tool Face 7=0 degrees
8. Pistons set #1, #2 and #3 under gauge: Tool Face 8=180 degrees Tool face increment is 60 degrees. Initial value "X" of the tool face depends on the angular position of the sliding sleeve. In the worst case, the difference between desired tool face and actual tool face is 30 degrees. With additional blades, the number of setting cycles would increase as a function of the equation:

$$s=2n$$

where s is the total possible number of settings and n is the number of blades. The number s can be reduced with the realization that all combinations are not necessary for downhole control when dealing with more than 3 blades.

Figure 7:
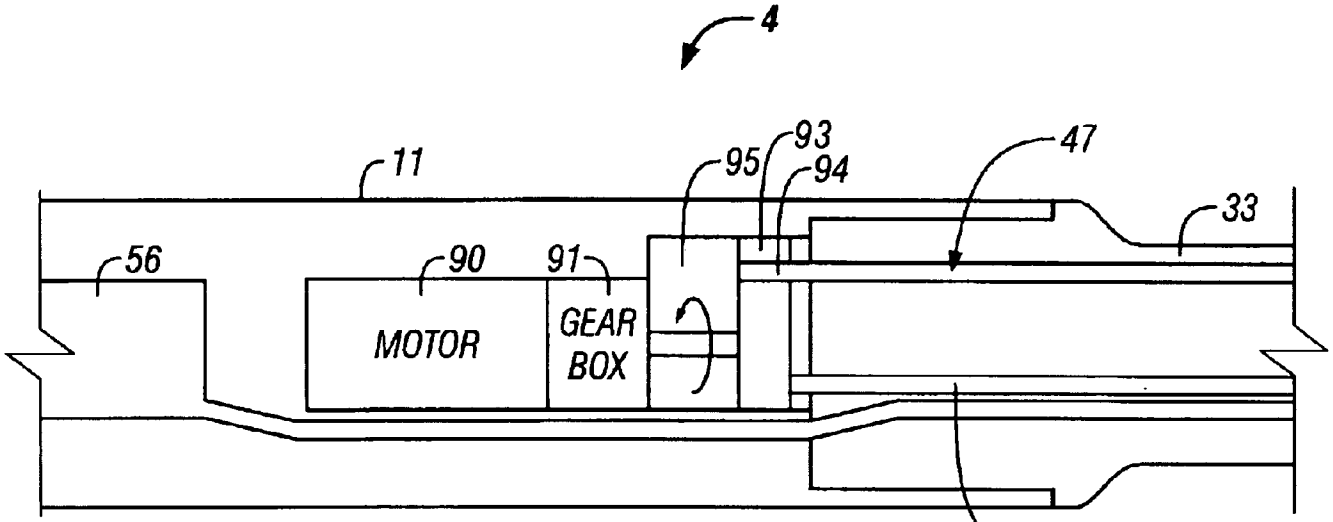
FIG. 7 is a longitudinal cross sectional view of a portion of the downhole tool of FIG. 2 having a motorized actuation system.
Figure 8:
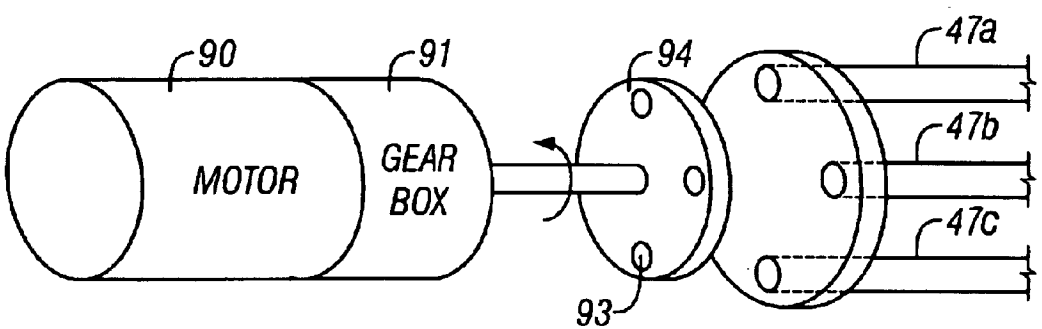
FIG. 8 is a schematic view of the actuation system of FIG. 7 depicting the operation of the motorized system.

Referring now to FIGS. 7 and 8, an alternate embodiment of the actuating system (45) utilizing a motor assembly is shown. FIG. 7 shows a portion of the tool (4) with a motor (90) and gearbox (91) positioned in the drill collar (11). As shown in FIG. 7, the central passage (56) is diverted around the actuation system (45) and through the tool (4). A portion of the fluid passes into a cavity (95) for selective distribution into conduits (47).

The motor (90) drives the gear box (91) which rotates a wheel (93) having openings (94) which selectively align with one or more conduits (47) to allow fluid to flow to the desired stabilizer blade (not shown) for activation. As shown in FIG. 7, the wheel (93) has an opening (94) aligned to conduit (47*a*) but the opening to conduit (47*b*) is not aligned with a hole (94) in wheel (93). In this position, the stabilizer blade linked to conduit (47*a*) will be activated, but the stabilizer blade linked to conduit (47*b*) will not. By selectively positioning the wheel (93) to align to the desired conduit, the stabilizer blades may be selectively activated according to achieve the desired tool face position as previously discussed.

The motor is preferably an electric stepper motor capable of indexing the wheel to the desired position. The motor may be used to control the valve assemblies and operate the pistons, as well as other operations. Alternatively, individual motor/valve assemblies could be implemented for each blade. A compensated chamber for the motor(s) and any additional control means may be required.

Figure 9:
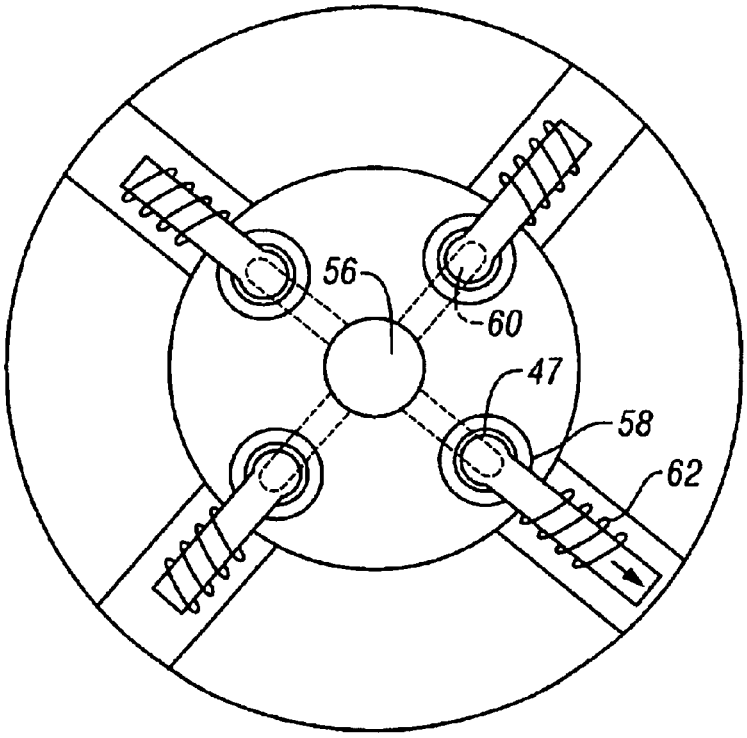
FIG. 9 is a transverse cross sectional view of an alternate embodiment of the actuation system of FIG. 5.

FIG. 9 shows an electromagnetic based actuating system. Closures (58) can be simultaneously or selectively retracted when coils (62) are energized in order that drilling fluid enters the corresponding conduits (47) through apertures (60).

The valve system (43) bypasses the fluid from the central passage (56) to the selected conduit(s) (47). Conduits (47) are selected in accordance to which pad is going to be actuated. Conduit(s) (47) forward the fluid to the distribution system (29) where it is sent to the corresponding piston(s) (53).

Figure 6:
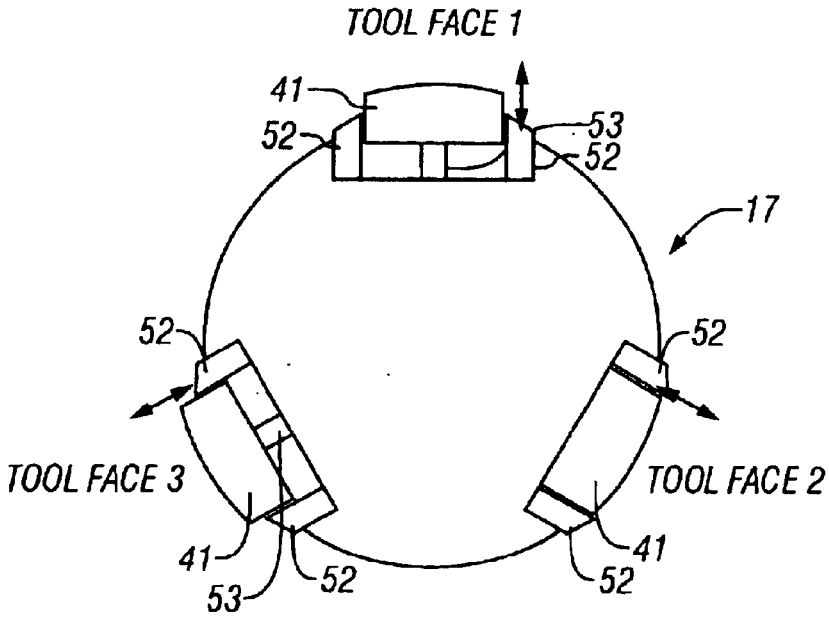
FIG. 6 is a schematic diagram depicting the optional tool face positions of a three stabilizer blade system.

The electromagnetic system could utilize the same cycled valve assembly as the system of FIG. 6 replacing the mechanical j-slot mechanism with an electromagnetic solenoid. Down-link telemetry could be utilized to communicate with the system to change settings. This implementation is still relatively simple and inexpensive. Added benefits would be control independent of pump cycles and the ability to increase blade count to maximize control. A magnetic assembly in the mud or an oil compensated chamber may be used in connection with this system.

Figure 10:
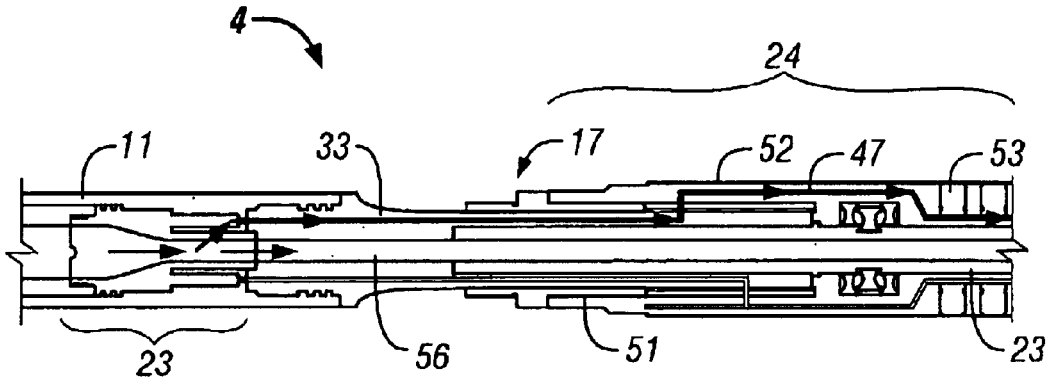
FIG. 10 is a longitudinal cross sectional view of a portion of the downhole tool of FIG. 2 depicting the flow of fluid therethrough.

FIGS. 10–14 show various views of the distribution system (29) of FIG. 5. The distribution section (29) of these figures extends through central passage (56) and to the pistons (53) in the sleeve section (24). FIG. 10 shows the path of the fluid through the downhole tool (4). The fluid passes through a central passage (56) extending through the drill collar (11), the flexible tube (33) and into the sleeve section (24) to activate the pistons (53).

Figure 11:
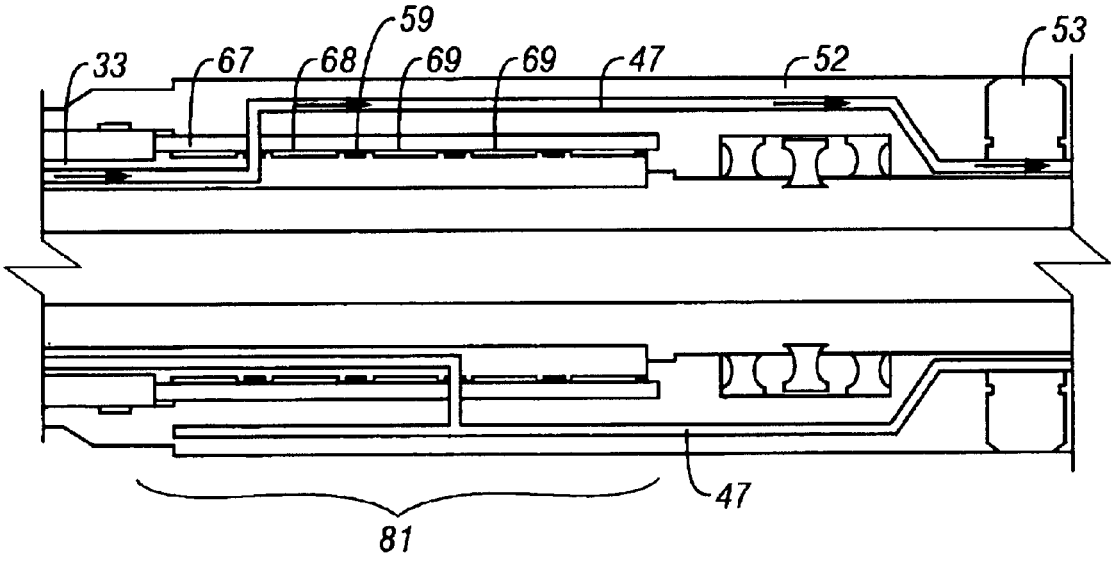
FIG. 11 is a longitudinal cross sectional view of a portion of the rotary steerable tool of FIG. 2 depicting a sealing mechanism and flow of fluid through the sleeve section.

As best seen in FIG. 11, the drilling tool (17) has a radial face seal assembly (81) which allows fluid to be passed through the conduits (47) while rotating on the inner diameter of the sleeve body (51). The radial face assembly (81) is made of two tightly toleranced sets of cylinders (not shown) which create a face seal. The radial face assembly (81) preferably has at least one sealing mechanism (87) and corresponding chamber (59) for each blade. The sealing mechanism (87) is preferably comprised of including an outer radial ring (67), an inner radial ring (69) and a rubber insert (68). The rubber inserts allow the system to seal given the relatively loose tolerances in the systems radial bearings. Fluid flows past inner radial ring (69) with rubber inserts (68) and an outer radial ring (67) through the conduits (47) to the pistons (53).

Figure 12:
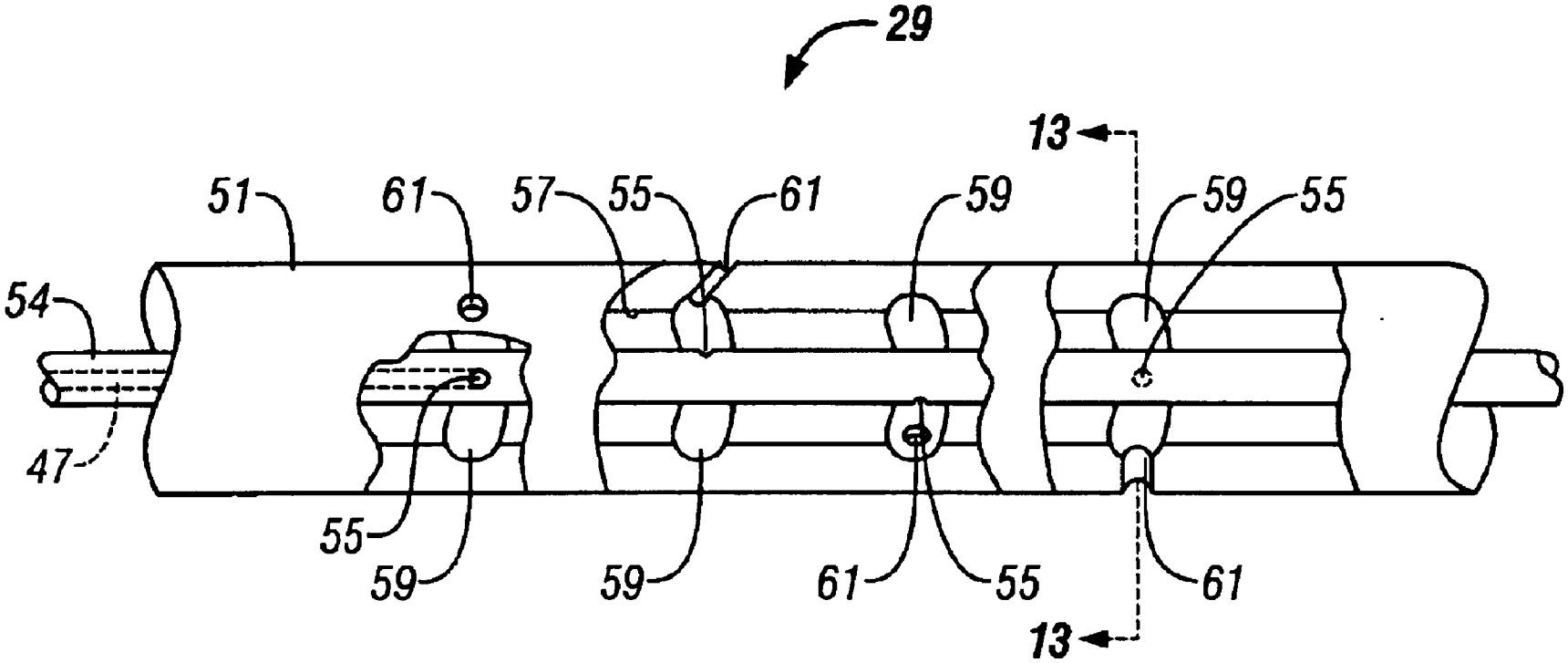
FIG. 12 is a longitudinal cross sectional view of the rotary steerable tool of FIG. 5 detailing the distribution section.
Figure 13:
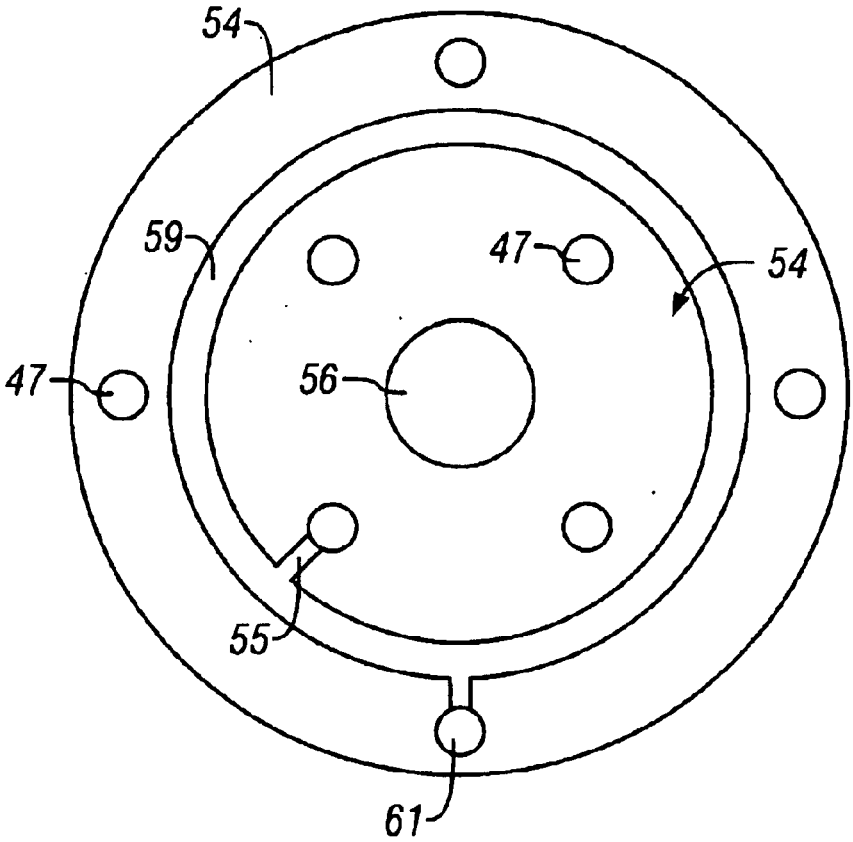
FIG. 13 is a transverse cross sectional view of the distribution section of FIG. 12, along 13-13'.
Figure 14:
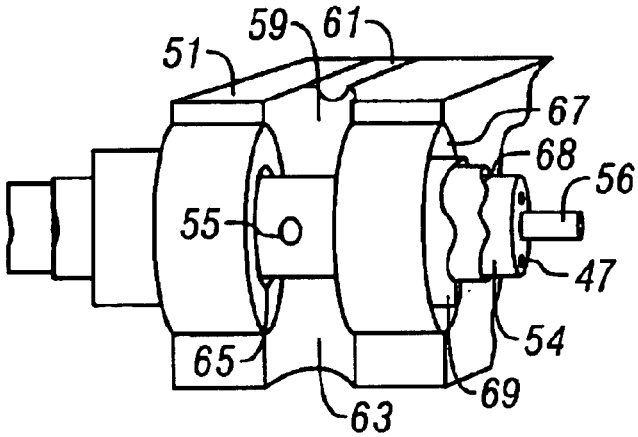
FIG. 14 is a perspective view of the sealing mechanism of FIG. 11.

Referring to FIGS. 12–14, orifices (55) are located on the outer surface of the central shaft (54) and each orifice (55) has a different location along the longitudinal axis of central shaft (54). Each conduit (47) runs through central shaft (54) and exits different orifices (55). The inner surface (57) of the sleeve (51) has embedded channels (59). Alternatively, the embedded channels (59) may also be positioned on the outer surface of the central shaft (54). Their position substantially coincides with the location of an orifice (55). Similarly, each channel has one or more orifices (61) inside its inner surface. Each channel (59) is isolated from the remaining channels (59) by seals (65) as shown in FIG. 14. Therefore, a chamber (63) is formed allowing that fluid enters only the assigned channel (59) when exiting a specific conduit (47). The fluid is directed, through orifice (61), to actuate the pad(s) (41).

Referring to FIG. 14, a portion of the distribution section (29) is shown in greater detail. The distribution section (29) contains channels (59) that are 360 degrees channels, perpendicular to the outer cylinder's longitudinal axis. The radial rings (67, 69) are located between the channels (59) and form a face seal (65). Radial rings (67, 69) are preferably wear resistant rings preferably of materials utilized in standard face seals, such as metal or composite. The radial rings may also result in a lossy seal system. Inner radial ring (69) is supported by a elastomeric ring (68) which allows the system to maintain a seal in the presence of radial tolerance mismatch. Elastomeric ring (68) can be, for example, made out of elastomer/rubber material.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drilling tool adapted for connection in a rotary drill string having at least one drill collar and a drill bit, the drilling tool comprising;

a shaft adapted for rotation of the drill bit;

a non-rotating sleeve having pads hydraulically extensible therefrom between extending and retracted positions, the sleeve positioned about at least a portion of the shaft;

a flexible tube adapted for coupling the drill collar to the shaft for transmitting torque therebetween, and coupling the drill collar to the sleeve for conducting fluid therebetween; and a valve system adapted for cooperating with the flexible tube to operatively conduct at least a portion of the drilling fluid to the sleeve for actuating the pads, whereby the pads move between the extended and retracted positions.

2. The drilling tool according to claim 1 wherein the flexible tube is a flexible shaft.

3. The drilling tool according to claim 1 wherein the pads are selectively extensible by application of drilling fluid thereto via the flexible tube and the valve system.

4. The drilling tool according to claim 1 further comprising at least one stabilizer blade located on the sleeve, each stabilizer blade having at least one pad therein.

5. The drilling tool according to claim 4 wherein each pad comprises a piston.

6. The drilling tool according to claim 5 wherein the at least one stabilizer blade comprises at least one first conduit adapted to conduct fluid from the sleeve to at least one pad contained therein.

7. The drilling tool according to claim 6 wherein a plurality of stabilizer blades are located on the sleeve, the plurality of stabilizer blades each having at least one pad therein.

8. The drilling tool according to claim 7 wherein the at least one hydraulically extensible pad comprises a piston.

9. The drilling tool according to claim 1, wherein;

the sleeve includes an inner surface, at least a first orifice, and at least a first conduit adapted to conduct the fluid from the first orifice to the pads, the inner surface having at least one channel embedded therein surrounding the shaft, the one channel being in fluid communication with the first orifice;

the shaft includes at least a second orifice; and further comprising first and second seals located between the shaft and the sleeve for sealing a chamber that includes the one channel and the first and second orifices.

10. The drilling tool according to claim 9 wherein each of the first and second seals comprise an inner and an outer ring.

11. The drilling tool according to claim 10 wherein the inner and outer rings are comprised of material selected from the group of metal and composite.

12. The drilling tool according to claim 10 where the inner and outer rings are comprised of a lossy seal system using pressure differentials to achieve piston extension.

13. The drilling tool according to claim 9 wherein;

the shaft comprises a plurality of third conduits, each one ending at a plurality of the second orifices and the sleeve comprises a plurality of first orifices and a plurality of the channels; and a plurality of the first and second seals are located between the shaft and the sleeve, for sealing a chamber that includes one of the plurality of channels, and one of the plurality of first and second orifices.

14. The drilling tool according to claim 13 wherein the sleeve comprises a plurality of the first orifices and a plurality of the hydraulically extensible pads.

15. The drilling tool according to claim 14 further comprising an actuating system adapted to actuate the valve system.

16. The drilling tool according to claim 15 wherein the actuating system comprises a j-slot mechanism.

17. The drilling tool according to claim 15 wherein the actuating system comprises a electromagnetic solenoid assembly.

18. The drilling tool according to claim 13 further comprising a plurality of the stabilizer blades located on the sleeve, the sleeve comprising a plurality of second conduits, and the plurality of stabilizer blades each containing at least one hydraulically extensible pad.

19. The drilling tool according to claim 18 wherein each of the plurality of stabilizer blades comprises at least one third conduit adapted to conduct fluid from each of the plurality of the first orifices to the at least one hydraulically extensible pad.

20. The drilling tool according to claim 19 further comprising an actuating system adapted to actuate the valve system.

21. The drilling tool according to claim 20 wherein each hydraulically extensible pad comprises a piston.

22. The drilling tool according to claim 20 wherein the actuating system comprises a j-slot mechanism.

23. The drilling tool according to claim 20 wherein the actuating system comprises an electromagnetic solenoid assembly.

24. The drilling tool according to claim 1 wherein the actuating system is contained in the drill collar.

25. The drilling tool according to claim 1 further comprising a sensor system for detecting the position of the sleeve in the wellbore.

26. The drilling tool according to claim 25 wherein the sensor system is contained in the drill collar.

27. A drilling tool positionable in a wellbore, the drilling tool adapted for connection in a rotary drill string having at least one drill collar and a drill bit for drilling the wellbore, the drilling tool comprising;

a shaft for rotating the drill bit;

a non-rotating sleeve having extensible pads therein, the sleeve positioned about at least a portion of the shaft;

a flexible tube adapted for coupling the drill collar to the shaft for transmitting torque therebetween, and coupling the drill collar to the sleeve for conducting fluid therebetween; and an actuator adapted for cooperating with the flexible tube so as to divert at least a portion of a fluid passing through the tool to the sleeve whereby the pads are selectively moved between an extended and retracted position.

28. A method of drilling a wellbore, comprising:

positioning a drilling tool within a rotary drill string disposed in a wellbore, the drilling tool having a shaft for rotating a bit within the drill string and a nonrotating sleeve with extensible pads therein, the sleeve being disposed about at least a portion of the shaft;

transmitting torque from the drill string rotation to the shaft so as to rotate the bit;

passing a fluid through the tool; and diverting at least a portion of the fluid to the sleeve for selective extension of the pads whereby the shaft and bits are pointed to drill in the desired direction.

* * * * *

UNITED STATES PATENT AND TRADEMARK OFFICE

CERTIFICATE OF CORRECTION

PATENT NO. : 6,840,336 B2
DATED : January 11, 2005
INVENTOR(S) : Nedele et al.

It is certified that error appears in the above-identified patent and that said Letters Patent is hereby corrected as shown below:

Title page,
Item [*] Notice, delete "This patent is subject to a terminal disclaimer." and insert in its place -- The term of this patent shall not extend beyond the expiration date of Pat. No. 6,285,276. --.
Item [57], ABSTRACT,
Line 10, "least-one" should read -- least one --.
Line 11, "4b, 5b)" should read -- (4b, 5b) --.

Column 5,
Line 62, "wherein at lease" should read -- wherein at least --.

Column 6,
Line 14, "a ascending" should read -- an ascending --.
Line 18, "control final" should read -- control signal --.
Line 18, "as claims" should read -- as claimed --.
Line 18, "on of the" should read -- one of the --.
Line 18, "as claims" should read -- as claimed --.

Signed and Sealed this

Fourth Day of October, 2005

JON W. DUDAS
*Director of the United States Patent and Trademark Office*